US006029282A

United States Patent [19]

Buschman

[11] Patent Number: 6,029,282

[45] Date of Patent: Feb. 29, 2000

[54] CYCLIST'S WIND NOISE LIMITING DEVICE

[76] Inventor: Thomas W. Buschman, 9000 Kirtland-Chardon Rd., Kirtland, Ohio 44094

[21] Appl. No.: 09/059,953

[22] Filed: Apr. 14, 1998

[51] Int. Cl.[7] ..... A42B 3/16; A61F 11/14

[52] U.S. Cl. ..... 2/422; 2/423; 128/866

[58] Field of Search ..... 2/422, 423, 421, 2/209, 184.5, 175.6, 909; 128/864, 866, 867; 181/129

[56] References Cited

U.S. PATENT DOCUMENTS

| | | | |
|---|---|---|---|
| 1,845,205 | 2/1932 | Smith | 128/864 |
| 4,370,758 | 2/1983 | Mattheis | 2/423 |
| 4,995,117 | 2/1991 | Mirage | 2/410 |
| 5,044,014 | 9/1991 | Cornale | 2/209 |
| 5,086,789 | 2/1992 | Tichy | 128/866 |
| 5,231,704 | 8/1993 | Hildenbrand | 2/423 |
| 5,323,493 | 6/1994 | Ogiba | 2/422 |
| 5,361,419 | 11/1994 | Bernstein | 2/423 |
| 5,412,810 | 5/1995 | Taniuchi | 2/424 |
| 5,477,564 | 12/1995 | Tichy | 2/423 |
| 5,860,166 | 1/1999 | Ritts | 2/209 |

FOREIGN PATENT DOCUMENTS

| | | | |
|---|---|---|---|
| 210875 | 2/1924 | United Kingdom | 2/423 |

*Primary Examiner*—Michael A. Neas

*Attorney, Agent, or Firm*—Fay, Sharpe, Fagan, Minnich & McKee, LLP

[57] ABSTRACT

A wind noise limiting device (10) selectively reducing wind noise while allowing ambient sounds to reach a wearer's ear (18). A sound-permeable body (20), is optionally shaped to surround an outer ear of the wearer, and includes an open-weave mesh (24) of a plastic material which permits air movement through holes in the mesh. Fibers (28) are attached to the mesh. The fibers alter the air flow passing through the device to reduce noise created by air movement across the mesh. The device is attached to a chin strap (12) of a helmet (14). In an alternate embodiment, the body is positioned in front of the ear, and interrupts moving air approaching the ear from the front.

25 Claims, 3 Drawing Sheets

CYCLIST'S WIND NOISE LIMITING DEVICE

BACKGROUND OF THE INVENTION

The present invention relates to the wind noise reductions arts. It finds particular application as an ear devices, such as ski helmets, head bands, visors, and face masks.

Wind noise, caused by the movement of air around parts of the outer ear is distracting and often uncomfortable for cyclists and others who are exposed to air movement across the ear. The noise often makes hearing of safety warnings, such as horns and other traffic noise, difficult, posing hazards to the cyclist. In addition, the constant wind noise creates fatigue which may contribute to accidents.

A number of devices have been developed to reduce wind noise. The devices typically employ a smooth, air-impermeable, or closely-woven material which deflects wind away from the ear. However, many of these devices tend to block both the undesirable wind noise and desirable noises, such as those of traffic and sounds of nature. Other devices replace the wind noise with a whistling noise of their own which, in turn, is undesirable.

The present invention provides a new and improved cyclist's wind noise limiting device which overcomes the above-referenced problems and others.

SUMMARY OF THE INVENTION

In accordance with the one aspect of the present invention, a wind noise limiting device for reducing wind noise while allowing ambient sounds to reach a wearer's ear is provided. The device includes a sound-permeable body which is interposed between a flow of moving air and the wearer's outer ear. The body includes a porous element formed from a rigid material that resists deflection by wind and having a multiplicity of closely-spaced openings. Fibers are attached to the porous element. The device further includes a securing system, attached to the body, for securing the body to the wearer's head.

In accordance with another aspect of the present invention, a wind noise limiting device for reducing wind noise is provided. The device includes a rigid, contoured element having a plurality of segments that define a multiplicity of apertures for passing the ambient sounds. The device further includes a multiplicity of fibers adhered to the segments to prevent the segments from causing wind roar and whistling noises. The fibers have free ends that are bent by passing wind to form a surface that is dynamically contoured by the fiber free-ends being dynamically aligned with the passing wind.

According to yet another aspect of the present invention, a method for limiting wind noise, while allowing ambient sounds to reach a wearer's ear is provided. The method includes forming an air permeable body with an open mesh which passes the ambient sounds but creates a whistling sound and adhering fibers to the mesh to prevent the whistling sound. The method further includes supporting the body adjacent the ear so that it deflects a flow of air approaching the ear and creates very small scale turbulences in the air outside of the human auditory range to reduce the wind noise.

One advantage of the present invention is that it selectively filters out wind noise while allowing the wearer to hear desirable noises, such as the noise of traffic.

Another advantage of the present invention is that it does not replace the wind noise with a whistling noise of its own.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
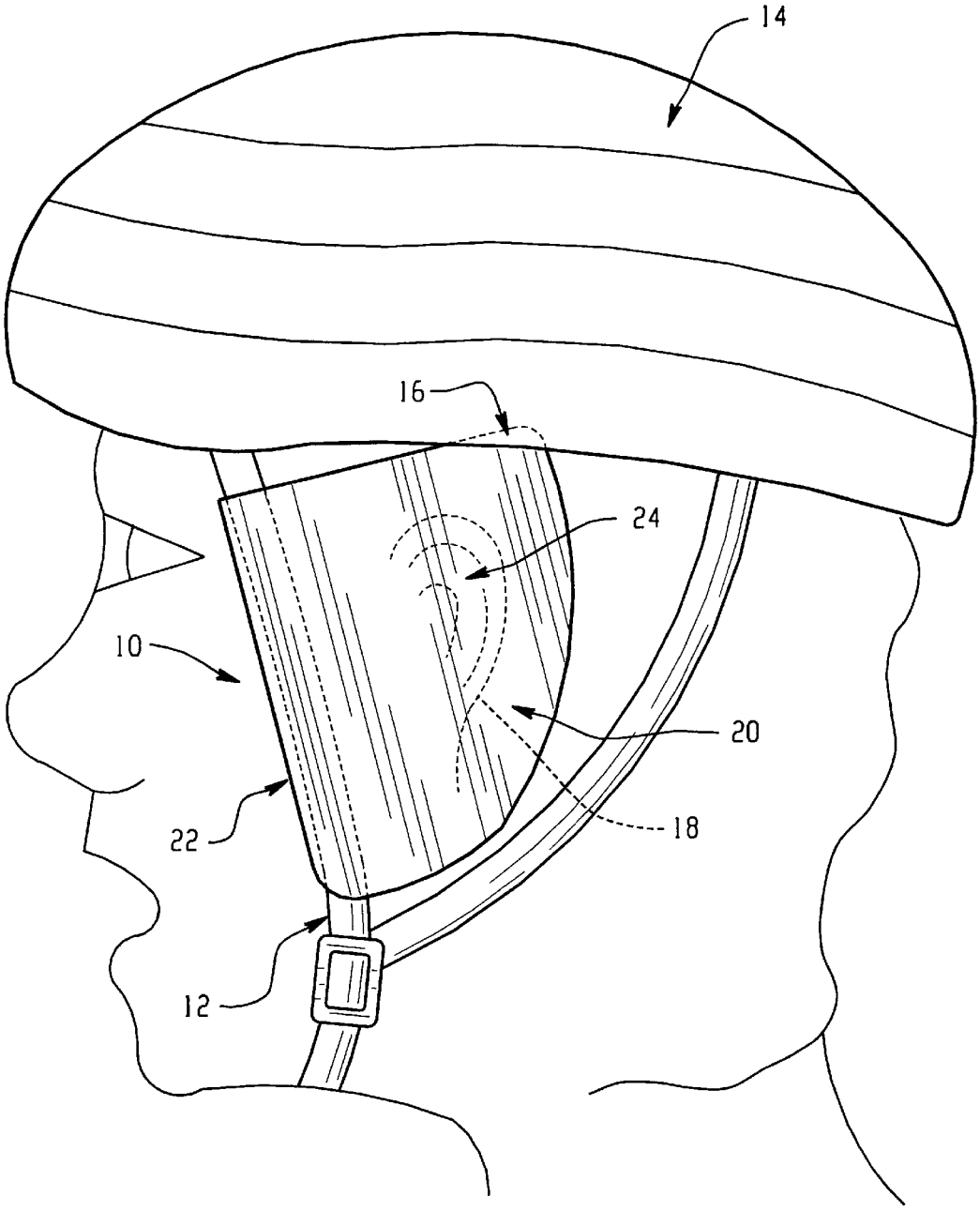
FIG. 1 is a side view showing a wind noise limiting device mounted to a helmet, and worn by a user, in accordance with the present invention.

With reference to FIG. 1, a wind noise limiting device 10 is mounted to a front chin strap 12 of a helmet 14. Preferably, an upper portion 16 of the device is tucked under a lower surface of the helmet to hold the device in place and reduce flapping movement of the device at high wind speeds. While the device is shown as being attached to the front strap of the helmet, it should be appreciated that the device is optionally attached to the helmet by hook and loop fabric connectors or other means which enable the device to be securely positioned.

The device 10 is positioned over an outer ear 18 of a wearer. The device includes a body 20 having a generally smoothly curving convex shape which curves outwardly, from an outer edge 22 of the body 20, towards a central region 24, so as to maintain a spaced relationship with the outer ear for comfort. The body curves inward behind the ear to contact the wearer's head. The body is sufficiently rigid that it does not tend to flex in the wind. In use, the outer edge 22 of the body snugly contacts the wearer's face and head around the outer ear, so that wind and sound reach the outer ear primarily through the device and so that gaps are eliminated that could otherwise cause wind turbulence and noise.

Figure 2:
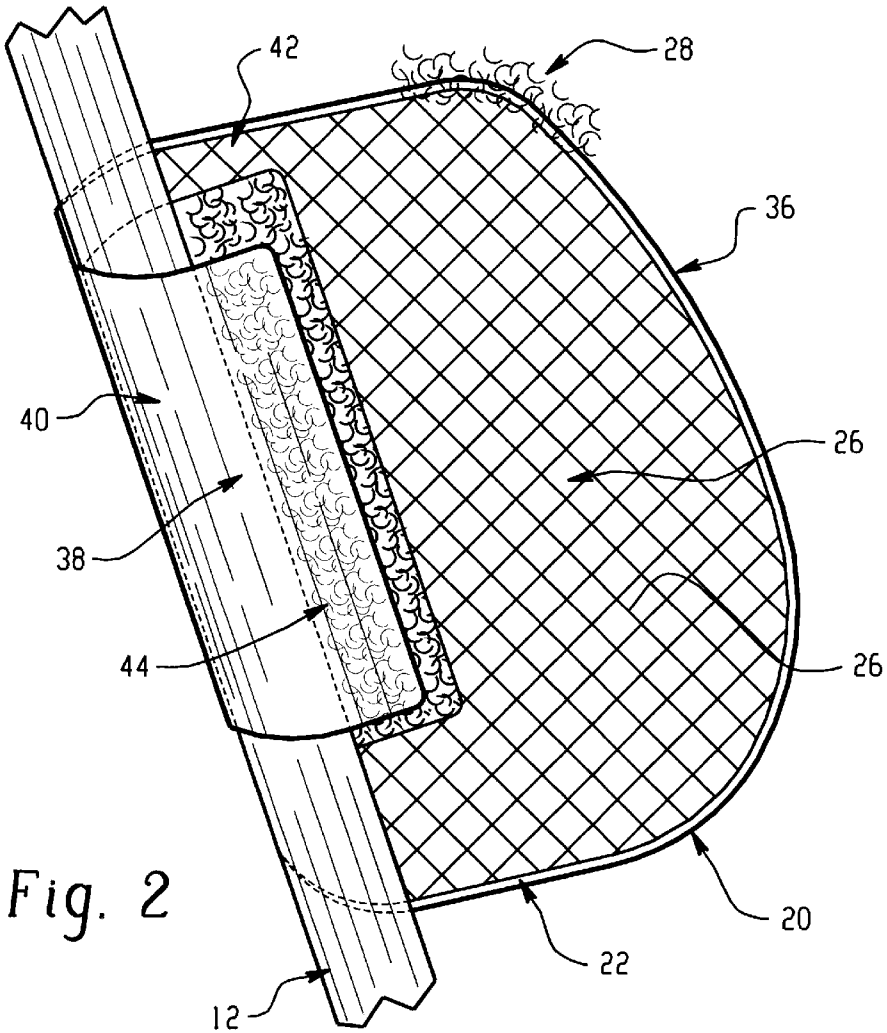
FIG. 2 is an enlarged rear view of the wind noise limiting device of FIG. 1, shown mounted to the front strap of a helmet, according to the present invention.

With reference also to FIG. 2, the body includes a sound-permeable porous element or mesh 26 which readily permits air movement therethrough. The porous element provides the rigidity of the body and is sized to surround the outer ear. Preferably, the porous element is formed from a material having closely-spaced openings, such as an open-weave mesh or highly-perforated framework. A particularly preferred material is a thermoformable plastic square mesh sheet composed of crossed filaments of about 0.2 mm diameter, spaced parallel in each direction about 0.5–1 mm. apart. The mesh is preferably formed into the convex shape of the body by heat molding. Alternatively, any suitably rigid, lightweight material is used for the mesh, such as a metal wire mesh.

The body 20 also includes fibers, or cilia 28 which are disposed so as to provide an open-spaced covering on the mesh 26 and over the openings in the mesh. The fibers are spaced so as to create turbulence in moving air approaching the body.

In one embodiment, the fibers 28 comprise flocking, which is adhesively attached to the mesh. One method of attaching the flocking to the mesh includes coating the mesh with an adhesive and then exposing the mesh to the flocking in an electrostatic chamber. Ends of the flocking fibers are attracted to the mesh and adhered to the adhesive.

The flocking, or other source of a loose compilation of fibers, is loosely packed in order to maintain much of the porous nature of the body, which is imparted by the mesh. In a preferred embodiment, the fibers make up around 20% or less of the volume occupied by the flocking or other source of fibers. The majority of the volume is consequently air spaces. Rather than serving primarily to deflect away from the body all the air reaching the body as do conventional, woven fiber ear protection systems, flocked fibers flex and align dynamically with the wind and allow air to pass between them. The fibers have a narrow cross section, with a diameter of the order of 5–6 thousandths of an inch (0.10–0.15 mm.), or less. Air that flows along such a narrow fiber forms a small turbulence as it flows over the small cross sectional end of the fibers and though the open spaces between the fibers. With such a small cross section, any noise attributable to the turbulence is outside of the human auditory range.

The fibers have a depth (the distance between the mesh and the outermost edge of the portion of the body occupied by the fibers) which is preferably much greater than the diameter of the fibers. A particularly preferred depth is around 0.03–0.5 cm, or around 20 times the diameter of the fibers, or greater.

Figure 3:
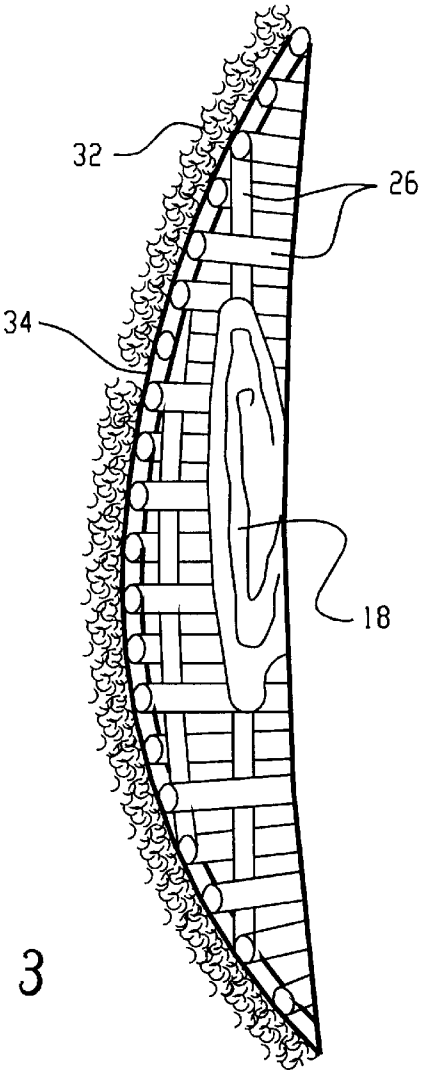
FIG. 3 is an enlarged side view of a second embodiment of the wind noise reduction limiting device according to the present invention.

In an alternate embodiment, the fibers 28 comprise a sheet of porous batting material 32, which is adhesively attached to an outer surface 34 of the mesh 26, as shown in FIG. 3. The batting is preferably sufficiently open that the fibers can again move with the wind flow and air can readily pass between the fibers. Each of the fibers preferably has only a small number of bonds which restrict movement of the fiber. Brushing may assist in loosening and aligning the fiber ends.

In a second alternate embodiment, not shown, the fibers are attached to a flexible substrate which in turn is adhered to the stiff mesh. Other means of attaching fibers to the mesh are contemplated, so long as the porous nature of the body is substantially maintained.

With reference once more to FIG. 2, a continuous bead 36, formed by heat melting of the outer edge 22 of the mesh, or by dipping the body into molten plastic, optionally smooths the edge of the device for a more comfortable fit against the face. Alternatively, an adhered strip of a comfortable material such as a foam is affixed to the edge of the mesh.

The device includes a securing system 38 for releasably mounting the device to the front strap 12 of a helmet. Preferably, the securing system includes a flap 40. A first side 42 of the flap is securely attached to the body 20. A second side 44 of the flap wraps around the front strap 12. The second side 44 of the flap is releasably attached to the body. Optionally, first and second sides each include engagable pieces of thistle cloth. The pieces of thistle cloth have hooks and loops which engage to attach the second side to the body. In this way, the flap 40 slidably engages the front strap, allowing the device to be vertically positioned on the head of the wearer.

Figure 4:
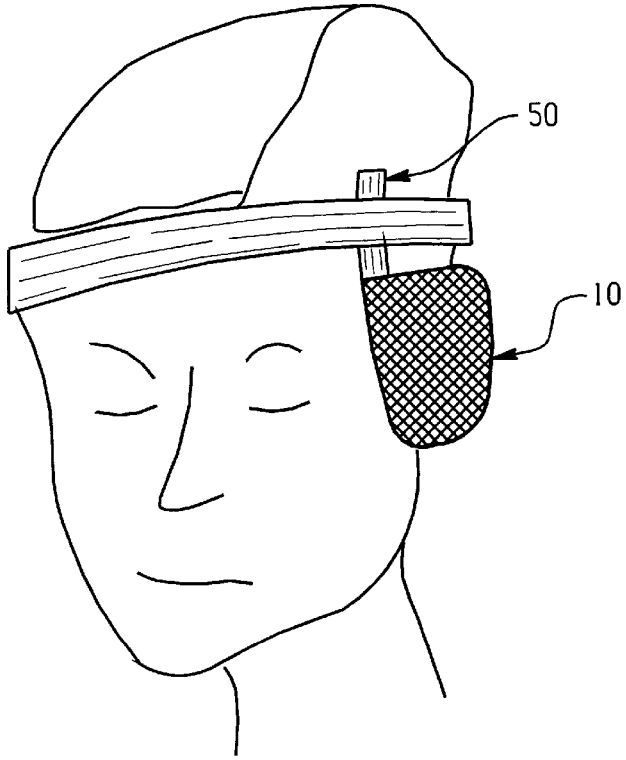
FIG. 4 is a third alternate embodiment of the wind noise limiting device supported on a strap which is held in position by a head band, according to the present invention; and, FIG. 5 is a fourth alternate embodiment of a wind noise limiting device according to the present invention.

Although the securing system 38 for the wind noise limiting device 10 has been described with reference to a flap for securing the device to the strap of a helmet, it should be appreciated that other means of securing the device to the head are also contemplated. Optionally, the device is integrally formed with the helmet or with a headband. FIG. 4, shows the device attached to a rigid strap 50 which is held in position by a headband, visor strap, or other similar means for positioning the device.

Figure 5:
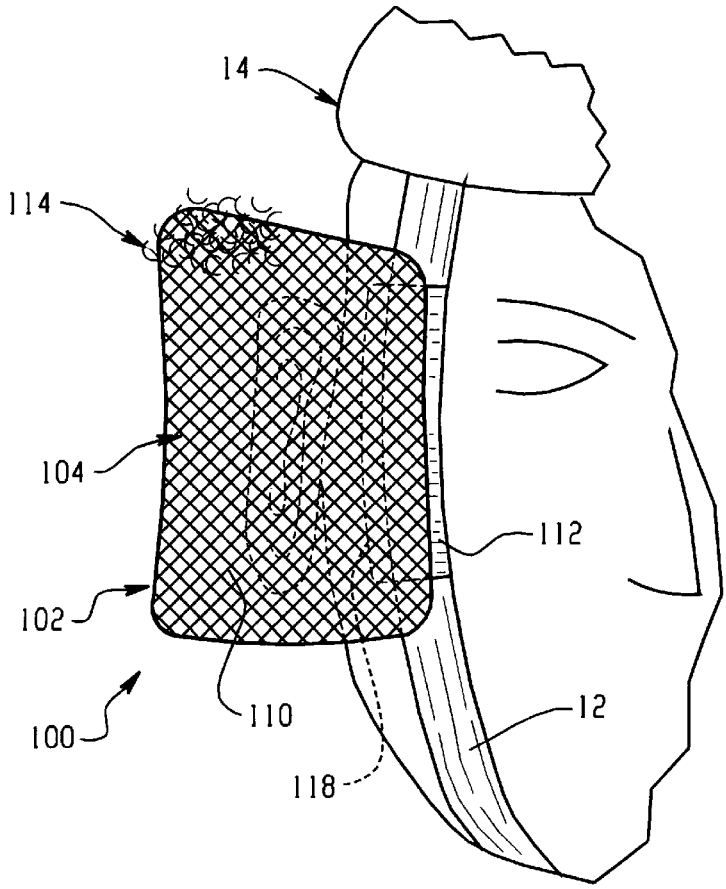

While the device has been previously described as surrounding the ear, in an alternative embodiment, shown in FIG. 5, a wind noise limiting device 100 is formed to extend outwardly, and substantially perpendicularly, from the face of the wearer. The device is positioned in front of the ear so that it faces the direction from which wind typically approaches the ear during cycling or other forward motion. The device 100 includes a sound-permeable body 102 shaped to intercept a flow of moving air flowing from in front of the wearer toward the ear. The body comprises a generally semicircular porous element 104 which preferably includes a plurality of crossed filaments 110. The body is attached by a mounting strip 112 to the front chin strap 12 of a helmet 14. The mounting strip holds the body firmly so that it does not flap excessively at high wind speeds. The filaments are formed from a material which imparts sufficient rigidity to prevent the device from being significantly deformed by the wind. A plastic mesh as described above can be heat set in a semicircle, and contoured to curve rearwardly toward the outer edges if desired. Optionally, the spacing between the filaments increases further away from the ear, toward the outer edge of the body.

Fibers 114 are attached to the filaments so as to partially cover spaces between the filaments, without appreciably limiting the porous nature of the device, in the manner previously described. The fibers limit the tendency of the body to cause a whistling sound as the wind passes through the body.

Optionally, the mounting strip 112 is releasably attached to the front strap by thistle cloth. Alternatively, the mounting strip includes a flap 118 which encircles the strap and is attached to the mounting strip in a similar manner to that described above for flap 38.

In this embodiment, the device does not enclose the ear, but rather breaks up wind movement approaching the outer ear from the front, creating turbulence outside of the human auditory range and thereby reducing the wind noise.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appending claims or the equivalence thereof.

Having thus described the preferred embodiment, the invention is now claimed to be:

1. A wind noise limiting device for reducing wind noise while allowing ambient sounds to reach a wearer's ear, the device comprising:

a sound-permeable body which is interposed between a flow of moving air and the wearer's outer ear, the body including:

a porous element formed from a rigid material that resists deflection by wind, the element including a multiplicity of closely-spaced openings, and a non-woven material, attached to the porous element. the non-woven material comprising less than about 20% of a volume occupied by the non-woven material to provide the body with a porous nature and create turbulence in moving air approaching the body; and, a securing system, attached to the body, for securing the body to the wearer's head.

2. The device of claim 1, wherein the body covers at least a portion of the outer ear.

3. The device of claim 1, wherein the body is shaped to surround an outer ear of the wearer.

4. A wind noise limiting device for reducing wind noise while allowing ambient sounds to reach a wearer's ear, the device comprising:

a sound-permeable body which is interposed between a flow of moving air and the wearer's outer ear, the body including:

a rigid material that resists deflection by wind including a multiplicity of closely-spaced openings. the material comprising a plurality of crossed filaments spaced at intervals of from about 0.5 to about 1.0 mm, and fibers attached to the rigid material; and a securing system, attached to the body, for securing the body to the wearer's head.

5. The device of claim 4, wherein the filaments form a plastic mesh.

6. The device of claim 4, wherein the securing system comprises a flap for securing the device to a front chin strap of a helmet.

7. The device of claim 6, wherein the flap is securely attached to the body by a first side of the flap and releasably attached to the body by a second side of the flap, the flap encircling the chin strap.

8. The device of claim 4, wherein the body is shaped so as interrupt moving air approaching from in front of the wearer.

9. The device of claim 8, wherein the body extends generally perpendicularly from the face of the wearer, and wherein the body defines a generally semicircular shape with the widest portion of the semicircle positioned closest to the face.

10. The device of claim 4, wherein the fibers are loosely packed.

11. A wind noise limiting device for reducing wind noise while allowing ambient sounds to reach a wearer's ear, the device comprising:

a sound-permeable porous element which is interposed between a flow of moving air and the wearer's outer ear, the porous element being shaped so as interrupt moving air approaching from in front of the wearer, the porous element extending generally perpendicularly from the face of the wearer, and defining a generally semicircular shape with the widest portion of the semicircle positioned closest to the face, the porous element including:

crossed filaments which define a multiplicity of closely-spaced openings, and which are more closely spaced near the ear of the wearer than toward an outer edge of the porous element, and fibers attached to the porous element; and a securing system, attached to the porous element, for securing the porous element to the wearer's head.

12. A wind noise limiting device for reducing wind noise while allowing ambient sounds to reach a wearer's ear, the device comprising:

a sound-permeable body which is interposed between a flow of moving air and the wearer's outer ear, the body including:

a porous element formed from a rigid material that resists deflection by wind, the porous element defining a multiplicity of closely-spaced openings, and fibers secured to an air-permeable substrate which is adhered to the porous element; and a securing system, attached to the body, for securing the body to the wearer's head.

13. The device of claim 12, wherein the fibers have a diameter of around 0.10–0.15 mm, or less and wherein the fibers comprise about 20%, or less, of a volume occupied by the fibers.

14. A wind noise limiting device for reducing wind noise while allowing ambient sounds to reach a wearer's ear, the device comprising:

a sound-permeable body which is interposed between a flow of moving air and the wearer's outer ear, the body including:

a porous element formed from a rigid material that resists deflection by wind, the porous element defining a multiplicity of closely-spaced openings, and fibers attached to the porous element, the fibers being loosely packed, the fibers comprising less than about 20% of a volume occupied by the fibers; and a securing system, attached to the body, for securing the body to the wearer's head.

15. The device of claim 14, wherein the fibers comprise flocking which is adhered to the porous element.

16. The device of claim 14, wherein the fibers comprise batting which is adhered to the porous element.

17. The device of claim 14, wherein the fibers are attached to the porous element so as to allow at least a portion of the fibers to move when contacted by moving air.

18. The device of claim 14, wherein the fibers extend generally perpendicularly away from the porous element.

19. The device of claim 14, wherein the fibers have free ends which move when contacted by moving air.

20. The device of claim 14, wherein the fibers have a diameter of around 0.10–0.15 mm, or less.

21. The device of claim 14, wherein the fibers have a depth which is about 20 times greater, or more, than a diameter of the fibers.

22. A wind noise limiting device for reducing wind noise while allowing ambient sounds to reach a wearer's ear, the device comprising:

a sound-permeable body which is interposed between a flow of moving air and the wearer's outer ear, the body including:

a porous element formed from a rigid material that resists deflection by wind, the porous element including a material that defines a multiplicity of closely-spaced openings, a bead extending along an outer edge of the body for providing a smooth surface in contact with a wearer's skin; and a securing system, attached to the body, for securing the body to the wearer's head.

23. A wind noise limiting device for reducing wind noise while allowing ambient sound to reach a wearers ear, the device comprising:

a rigid, contoured element having a plurality of segments that define a multiplicity of apertures for passing the ambient sounds; and, a multiplicity of fibers adhered to the segments to prevent the segments from causing wind roar and whistling noises, the fibers having free ends that are bent by passing wind and dynamically contoured to prevent the rigid element from creating turbulence that create noises in the human auditory range.

24. The device of claim 23 wherein the contoured element is a thermoformed plastic mesh and the fibers are adhered by an attached end to the mesh.

25. A method for limiting wind noise, while allowing ambient sounds to reach a wearer's ear, the method comprising:

forming an air permeable body with an open mesh which passes the ambient sounds but creates a whistling sound;

adhering fibers to the mesh adjacent a first end of each fiber, such that a second end of each of the fibers extends from the mesh and is free to move in the passing wind to prevent the whistling sound; and, supporting the body adjacent the ear so that it is positioned in a flow path of air approaching the ear and creates very small scale turbulences in the air outside of the human auditory range to reduce the wind noise.

* * * * *